US011071397B1

(12) United States Patent
Sprunk

(10) Patent No.: US 11,071,397 B1
(45) Date of Patent: Jul. 27, 2021

(54) STAND FOR HOLDING SMART WATCH BANDS

(71) Applicant: Gregory Allen Sprunk, Scottsdale, AZ (US)

(72) Inventor: Gregory Allen Sprunk, Scottsdale, AZ (US)

( * ) Notice: Subject to any disclaimer, the term of this patent is extended or adjusted under 35 U.S.C. 154(b) by 18 days.

(21) Appl. No.: 16/593,795

(22) Filed: Oct. 4, 2019

Related U.S. Application Data

(60) Provisional application No. 61/833,124, filed on Jun. 10, 2013.

(51) Int. Cl.
*A47F 7/02* (2006.01)
*A47F 7/03* (2006.01)
*A47F 7/024* (2006.01)

(52) U.S. Cl.
CPC ..... *A47F 7/022* (2013.01); *A47F 7/03* (2013.01); *A47F 7/02* (2013.01); *A47F 7/024* (2013.01)

(58) Field of Classification Search
CPC .. A47F 7/022; A47F 7/02; A47F 7/024; A47F 7/03
USPC ..... 248/688, 110, 113, 114, 115, 116, 121, 248/158, 174, 176.1, 346.03, 346.04; 211/85.2, 60.1, 65, 70.1, 70.7, 70.8
See application file for complete search history.

(56) References Cited

U.S. PATENT DOCUMENTS 2,926,519 A * 3/1960 Setterberg ..... G04D 7/009 73/1.52
4,071,212 A * 1/1978 Burrows ..... A47G 21/14 211/70.7
4,650,077 A * 3/1987 Droz ..... A47F 7/022 206/480
4,727,992 A * 3/1988 Sharp ..... A47F 7/024 211/4
4,874,100 A * 10/1989 Smagula ..... A47G 25/743 211/60.1
4,986,426 A * 1/1991 Niklaus ..... A47F 5/11 211/85.2
5,033,625 A * 7/1991 Campbell ..... A47F 7/02 211/85.2
5,046,624 A * 9/1991 Murphy ..... A61B 50/20 211/70.6
5,067,617 A * 11/1991 Caldwell ..... A47F 5/0807 211/85.2
6,209,828 B1 * 4/2001 Au ..... A47F 7/022 206/301
6,375,018 B1 * 4/2002 Clement ..... A47F 7/02 211/85.2
6,969,498 B1 * 11/2005 Riley ..... A61L 2/26 206/363
7,721,899 B2 * 5/2010 Lambert ..... A47K 1/09 211/65

(Continued)

*Primary Examiner* — Eret C McNichols
*Assistant Examiner* — Michael McDuffie
(74) *Attorney, Agent, or Firm* — Plager Schack LLP; Mark H. Plager; Michael J. O'Brien

(57) ABSTRACT

A stand assembly is configured to store at least one smart watch band. The stand assembly has a stand base plate, smoothly connected to a stand top plate with a stand neck. A top rack is operably connected to the stand top plate. A stand top plate rounded slot width is less than a top rack rounded slot width creating a stand top plate rounded slot ledge. The stand top plate rounded slot ledge is configured to accommodate a pin of a smartwatch band.

2 Claims, 4 Drawing Sheets

(56) References Cited

U.S. PATENT DOCUMENTS

| | | | | |
|---|---|---|---|---|
| 8,162,156 | B1 * | 4/2012 | Crisman | G10D 13/12 211/85.6 |
| 10,092,116 | B1 * | 10/2018 | Johns | A47F 7/022 |
| 2002/0066704 | A1 * | 6/2002 | Poppe | A47F 7/00 211/26 |
| 2003/0034315 | A1 * | 2/2003 | Tayebi | A47K 1/09 211/65 |
| 2003/0089673 | A1 * | 5/2003 | Herren | A47K 1/09 211/66 |
| 2004/0144903 | A1 * | 7/2004 | Cherubini | A61J 1/16 248/231.71 |
| 2009/0242442 | A1 * | 10/2009 | Kaddissi | A47K 1/09 206/362.3 |
| 2010/0270443 | A1 * | 10/2010 | Holcomb | A63H 27/10 248/176.1 |
| 2010/0320338 | A1 * | 12/2010 | Chen | A47F 7/0028 248/121 |
| 2015/0014492 | A1 * | 1/2015 | Sharpe | F16M 13/02 248/121 |

* cited by examiner

STAND FOR HOLDING SMART WATCH BANDS

RELATED APPLICATION

This application claims priority to provisional patent application U.S. Ser. No. 61/833,124 filed on Apr. 12, 2019, the entire contents of which is herein incorporated by reference.

BACKGROUND

The embodiments herein relate generally to a stand for holding smart watch bands.

Prior to embodiments of the disclosed invention it was hard to keep smart watch bands organized and in one place. The invention of smart watch holding stand holds multiple sets of smart watches and their bands in a vertical in one place to keep them organized and accessible. Embodiments of the disclosed invention solve this problem.

SUMMARY

A stand assembly is configured to store at least one smart watch band. The stand assembly comprises a stand base plate, smoothly connected to a stand top plate with a stand neck; the stand top plate further comprises a stand top plate shaft joined to a plurality of stand top plate rounded teeth separated by a plurality of stand top plate rounded slots. Each stand top plate rounded slot has a stand top plate rounded slot width and a stand top plate rounded slot height.

A top rack is operably connected to the stand top plate, and further comprises a top rack shaft joined to a plurality of top rack teeth separated by a plurality of top rack rounded slots. Each top rack rounded slot has a top rack rounded slot width and a top rack rounded slot height;

The stand top plate rounded slot width is less than the top rack rounded slot width creating a stand top plate rounded slot ledge. The stand top plate rounded slot ledge is configured to accommodate a pin of a smartwatch band.

The top rack shaft further comprises a top rack first ledge separated from a top rack second ledge by a top rack neck opening. The top rack first ledge and the top rack second ledge wrap around a stand top plate shaft outer edge leaving a gap for the stand neck.

The top rack further comprises a top rack central opening arranged on top of the top rack shaft. A wire opening extends from the top rack central opening to an outer edge of the top rack shaft. A plurality of charger slots is arranged within the top rack central opening.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
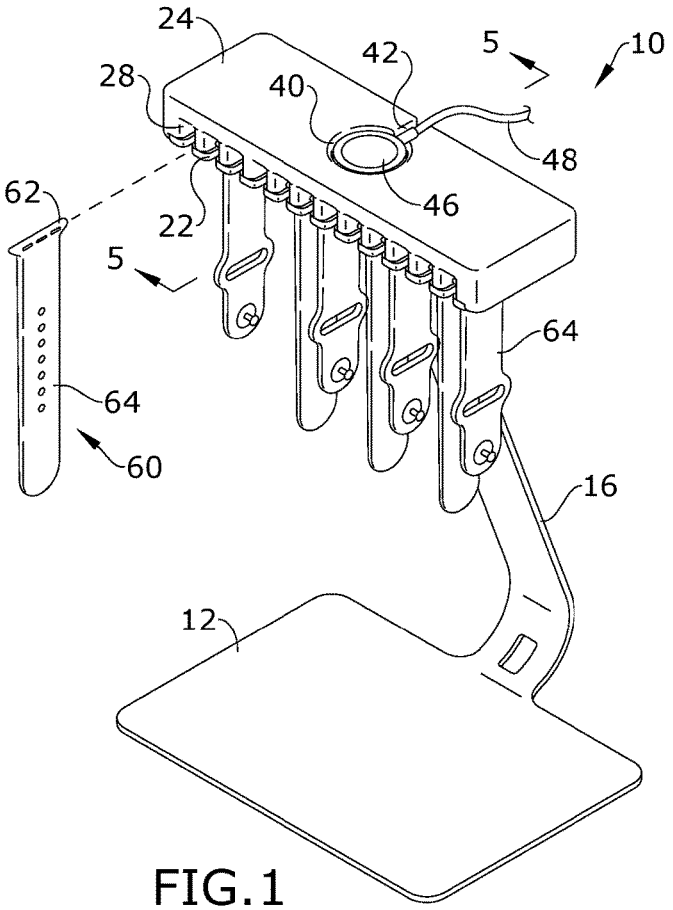
FIG. 1 shows a top perspective view of one embodiment of the present invention.
Figure 2:
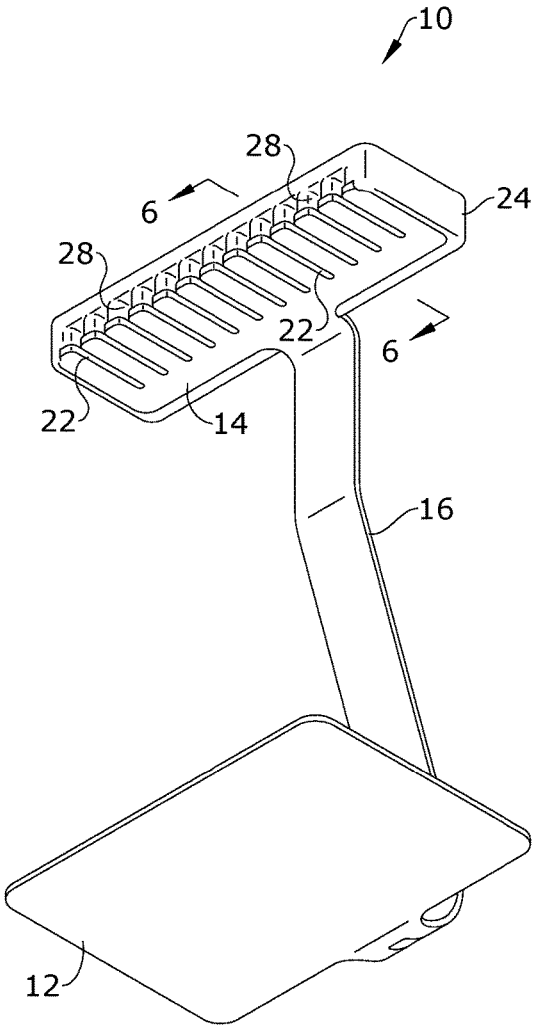
FIG. 2 shows a bottom perspective view of one embodiment of the present invention.
Figure 3:
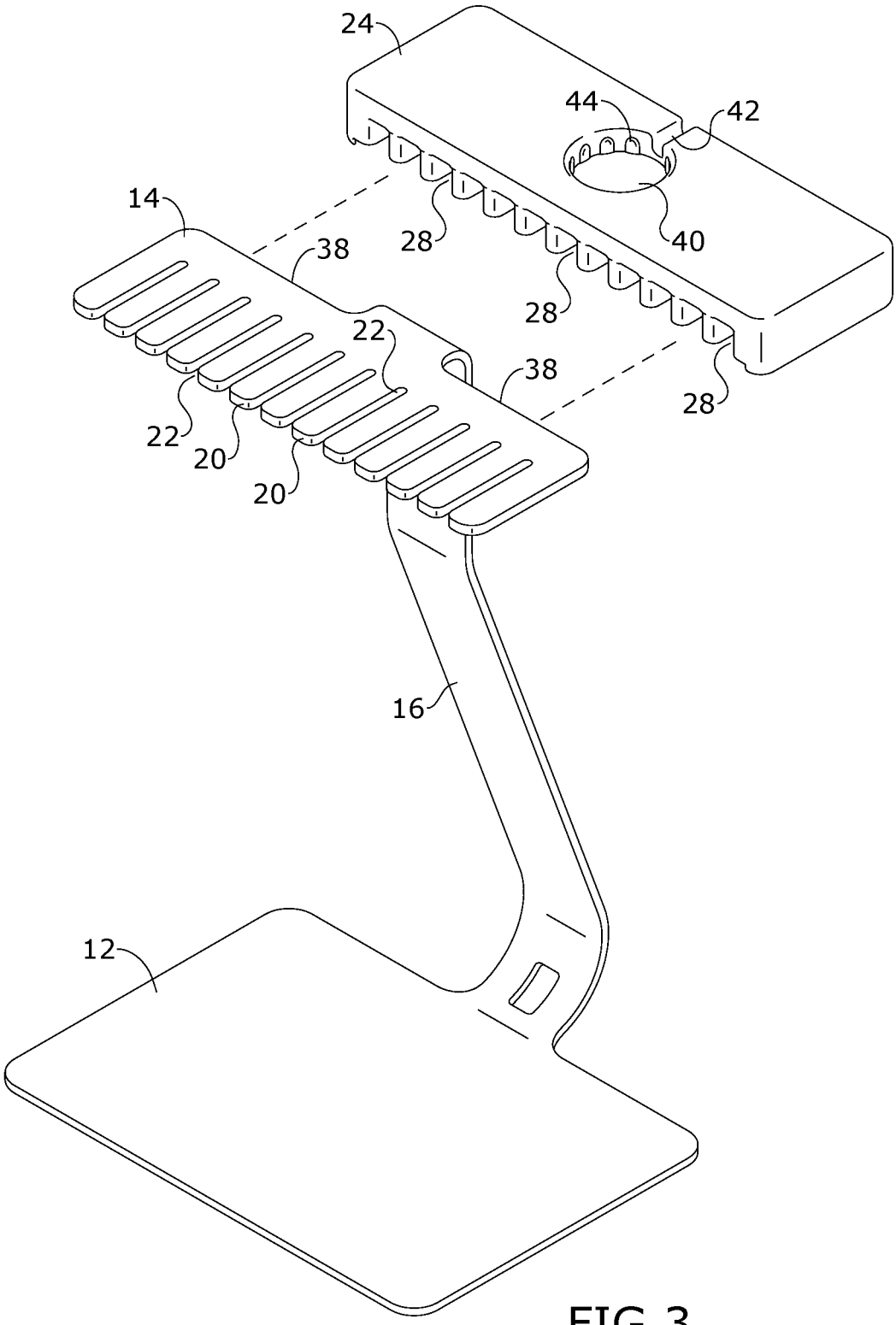
FIG. 3 shows a top exploded view of one embodiment of the present invention.
Figure 4:
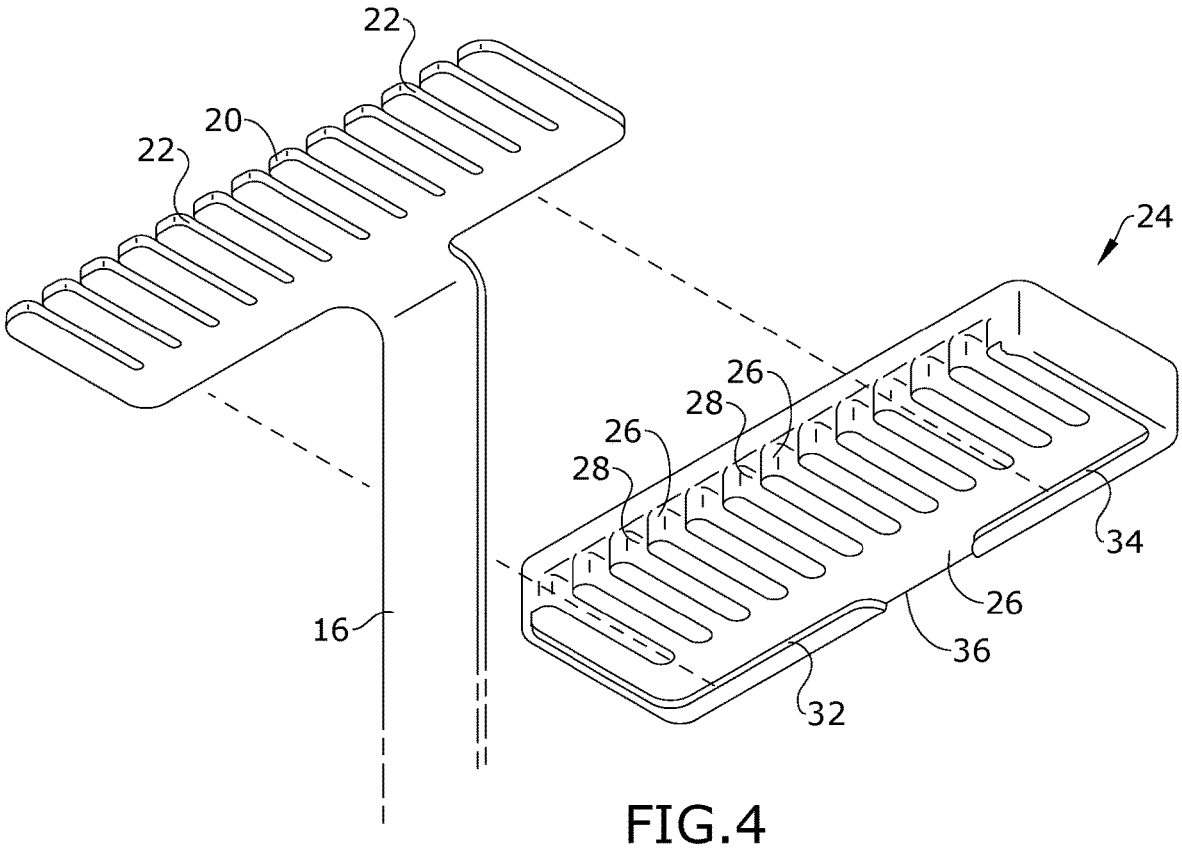
FIG. 4 shows a bottom detail exploded view of one embodiment of the present invention.
Figure 5:
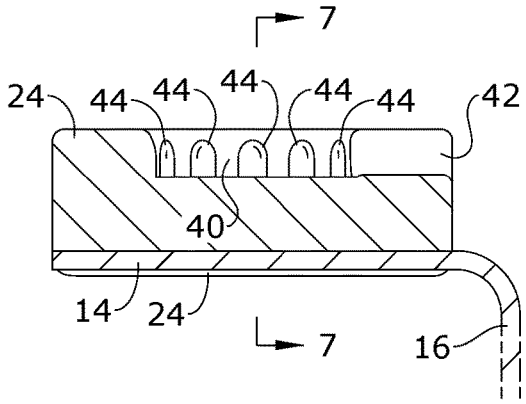
FIG. 5 shows a section view of one embodiment of the present invention taken along line 5-5 in FIG. 1.
Figure 6:
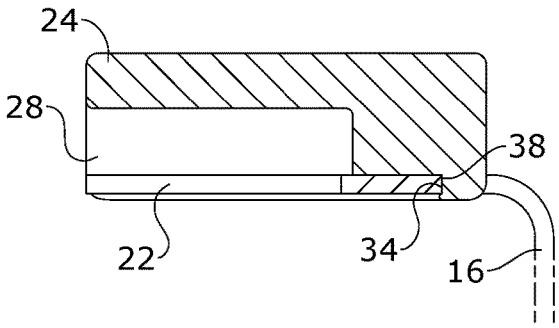
FIG. 6 shows a section view of one embodiment of the present invention taken along line 6-6 in FIG. 2.
Figure 7:
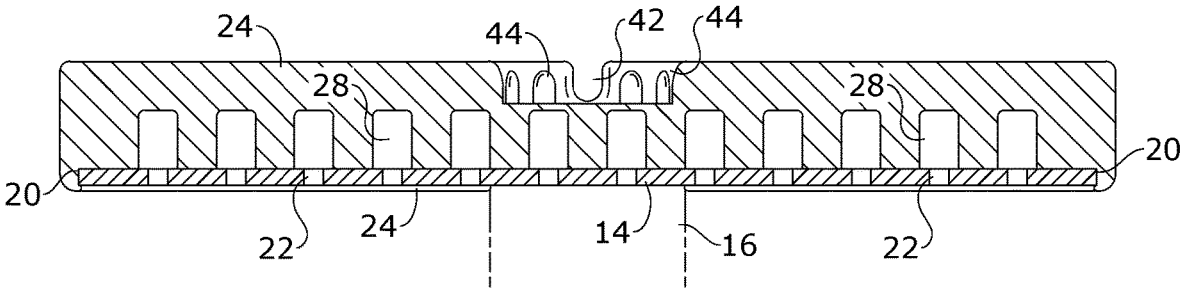
FIG. 7 shows a section view of one embodiment of the present invention taken along line 7-7 in FIG. 5.
Figure 8:
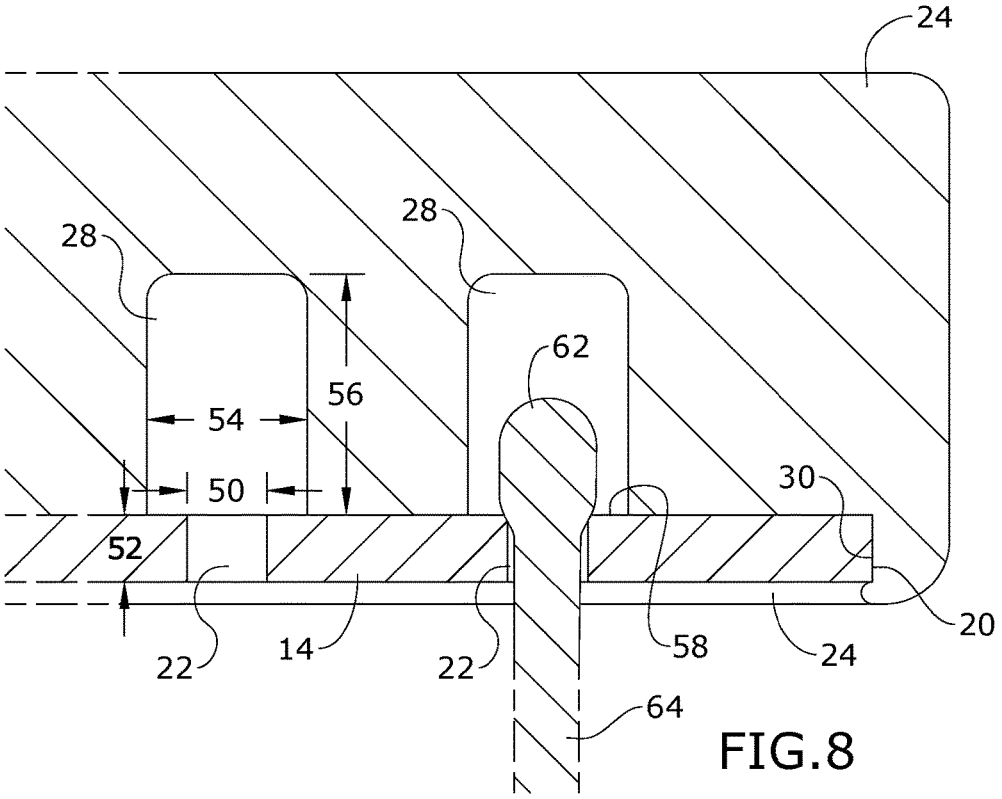
FIG. 8 shows a detail section view of one embodiment of the present invention.

By way of example, and referring to FIGS. 1-8, one embodiment of a stand assembly 10 further comprises a stand base plate 12. The stand base plate 12 is smoothly connected to a stand top plate 14 with a stand neck 16. The stand top plate 14 is arranged like a comb with a stand top plate shaft 18 joined to a plurality of stand top plate rounded teeth 20 separated by a plurality of stand top plate rounded slots 22.

The stand top plate 14 is operably connected to a top rack 24. The top rack 24 is also arranged like a comb having a top rack shaft 26 joined to a plurality of top rack teeth 28 separated by a plurality of top rack rounded slots 30. The top rack shaft 26 further comprises a top rack first ledge 32 separated from a top rack second ledge 34 by a top rack neck opening 36. In use, the top rack 24 rests on top of the top rack 24 such that the top rack first ledge 32 and the top rack second ledge 34 wrap around a stand top plate shaft outer edge 38 leaving a gap for the stand neck 16.

The top rack 24 further comprises a top rack central opening 40 arranged on top of the top rack shaft 26. The top rack central opening 40 is approximately cylindrical, centrally located on the top rack shaft 26 and further comprises a wire opening 42 that extends to an outer edge of the top rack shaft 26. The top rack central opening 40 further comprises a plurality of charger slots 44. In use, a smart watch charger 46 can fit into the top rack central opening 40 such that a smart watch charger cord 48 extends through the wire opening 42. The plurality of charger slots 44 operated to hold the smart watch charger 46 in place.

Each stand top plate rounded slot 22 has a stand top plate rounded slot width 50 and a stand top plate rounded slot height 52. Each top rack rounded slot 30 has a top rack rounded slot width 54 and a top rack rounded slot height 56. It is critical that the stand top plate rounded slot width 50 be less than the top rack rounded slot width 54 creating a stand top plate rounded slot ledge 58.

A smartwatch band 60 has a pin 62 which is wider than a strap 64. The pin rests upon the stand top plate rounded slot ledge 58.

As used in this application "smooth" means smooth enough to accomplish the inventions purpose. "Smoothly connected" means joined in a manner to accommodate the insertion of watch bands without interference from protrusions.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A stand assembly, configured to store at least one smart watch band; the stand assembly comprising:

a stand base plate, connected to a stand top plate with a stand neck; the stand top plate further comprises a stand top plate shaft joined to a plurality of stand top plate rounded teeth separated by a plurality of stand top plate rounded slots; wherein each stand top plate rounded slot has a stand top plate rounded slot width and a stand top plate rounded slot height;

a top rack, operably connected to the stand top plate, and further comprising: a top rack shaft joined to a plurality of top rack teeth separated by a plurality of top rack rounded slots;

wherein each top rack rounded slot has a top rack rounded slot width and a top rack rounded slot height;

wherein the stand top plate rounded slot width is less than the top rack rounded slot width creating a stand top plate rounded slot ledge; wherein the stand top plate rounded slot ledge is configured to accommodate a pin of a smartwatch band;

wherein the top rack shaft further comprises a top rack first ledge separated from a top rack second ledge by a top rack neck opening;

wherein the top rack first ledge and the top rack second ledge wrap around a stand top plate shaft outer edge leaving a gap for the stand neck.

2. The stand assembly of claim 1, wherein the top rack further comprises:

a top rack central opening arranged on top of the top rack shaft;

a wire opening, extending from the top rack central opening to an outer edge of the top rack shaft; and a plurality of charger slots, arranged within the top rack central opening.

* * * * *